United States Patent [19]

Cowan

[11] 4,053,157

[45] Oct. 11, 1977

[54] BOARD GAME APPARATUS

[76] Inventor: Gary J. Cowan, 6952 Bruckner, Detroit, Mich. 48210

[21] Appl. No.: 737,066

[22] Filed: Nov. 1, 1976

[51] Int. Cl.[2] ..... A63F 3/00

[52] U.S. Cl. ..... 273/134 AT; 273/134 C; 273/134 AD

[58] Field of Search ..... 273/134

[56] References Cited

U.S. PATENT DOCUMENTS

| | | | |
|---|---|---|---|
| 3,367,662 | 2/1968 | Charles et al. | 273/134 AD |

FOREIGN PATENT DOCUMENTS

| | | | |
|---|---|---|---|
| 515,188 | 11/1939 | United Kingdom | 273/134 C |
| 525,521 | 8/1940 | United Kingdom | 273/134 AC |
| 623,788 | 5/1949 | United Kingdom | 273/134 AC |
| 709,543 | 5/1954 | United Kingdom | 273/134 C |

*Primary Examiner*—Delbert B. Lowe

*Attorney, Agent, or Firm*—Gifford, Chandler, Sheridan & Sprinkle

[57] ABSTRACT

A game apparatus and method for playing the game including a game board having a plurality of squares located along each of its sides and bearing instructional information, a plurality of play directing cards which relate to the instructional information in the game board squares, random monetary units, a pair of dice to be thrown in turn by the players of the game, and game pieces representing human beings and motor vehicles to be moved around the game board a number of game board squares corresponding to the number showing on the dice thrown by the player.

The players begin the game having no money or other assets and having only a game piece representing a human being which allows a player to throw only one die to determine the number of game board squares to move the game piece. An intermediate object of the game is to obtain a game piece representing a motor vehicle which allows the player to throw a pair of dice to determine the number of game board squares to move the game piece. The ultimate object of the game is to be the first player to accumulate total assets of at least $25,000 and zero liabilities.

8 Claims, 11 Drawing Figures

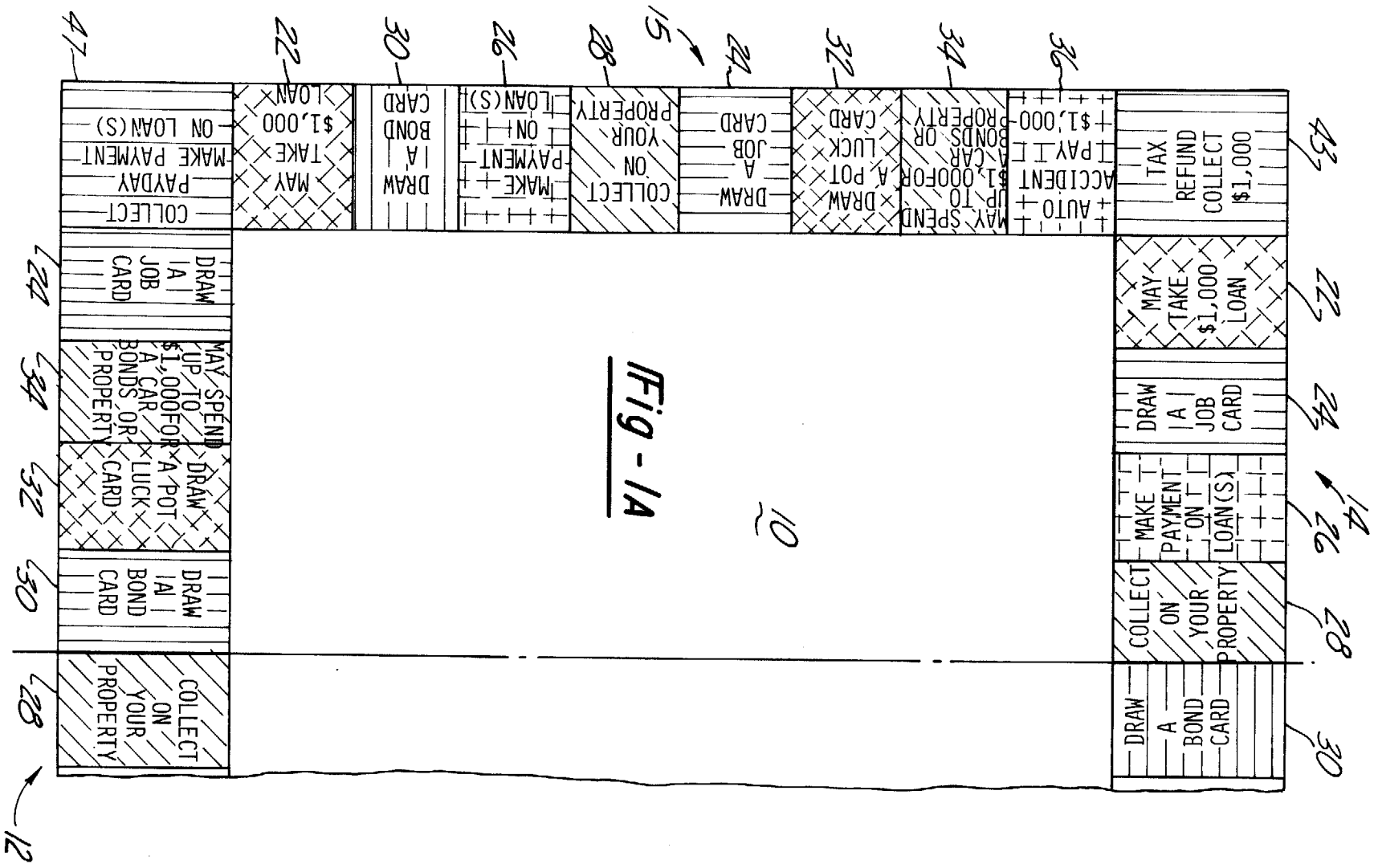
14
43
22
24
26
28
30
TAX REFUND COLLECT $1,000
MAY TAKE $1,000 LOAN
DRAW A JOB CARD
MAKE PAYMENT ON LOAN(S)
COLLECT ON YOUR PROPERTY
DRAW A BOND CARD
36
AUTO ACCIDENT PAY $1,000
34
MAY SPEND UP TO $1,000 FOR A CAR BONDS OR PROPERTY
32
DRAW A POT LUCK CARD
10
24
DRAW A JOB CARD
15
28
COLLECT ON YOUR PROPERTY
26
MAKE PAYMENT ON LOAN(S)
30
DRAW A BOND CARD
22
MAY TAKE $1,000 LOAN
Fig - 1A
47
COLLECT
PAYDAY
MAKE PAYMENT ON LOAN(S)
DRAW A JOB CARD
MAY SPEND UP TO $1,000 FOR A CAR BONDS OR PROPERTY
DRAW A POT LUCK CARD
DRAW A BOND CARD
COLLECT ON YOUR PROPERTY
24
34
32
30
28
12

BOARD GAME APPARATUS

BACKGROUND OF THE INVENTION

1. Field of the Invention

The present invention relates to a novel game including a game apparatus for carrying out or executing the novel game, and a method of playing and utilizing the game. In particular, the present invention relates to a game and game apparatus simulating occurrences which happen to individuals in the process of everyday living.

2. Description of the Prior Art

There are numerous prior art games and game apparatus which involve moving game pieces around a game board having squares along its sides in response to a throw of a pair of dice, and following instructions carried on the square on which the game piece comes to rest. Some of these games also attempt to simulate occurrences of everyday life in various aspects.

No prior art device known to me so simulates everyday occurrences as realistically as the novel game of the present invention, by requiring the players to begin the game having absolutely no assets or liabilities.

SUMMARY OF THE INVENTION

The present invention provides a game apparatus including a plurality of first movable game pieces generally resembling human beings and a like plurality of second game pieces generally resemtling motor vehicles, such as an automobile. The game apparatus also includes a game board having a plurality of squares located along each of its sides having directional or instructional information printed therein, and a plurality of information cards and play directing cards having information printed thereon which relates to information in various game board squares. Also included are an amount of artificial money in random monetary units, and a pair of dice.

BRIEF DESCRIPTION OF THE DRAWINGS

FIGS. 1 and 1A illustrate a plan view of a game board, the game board being substantially symmetrical about the centerline thereof;

DETAILED DESCRIPTION

Figure 1:
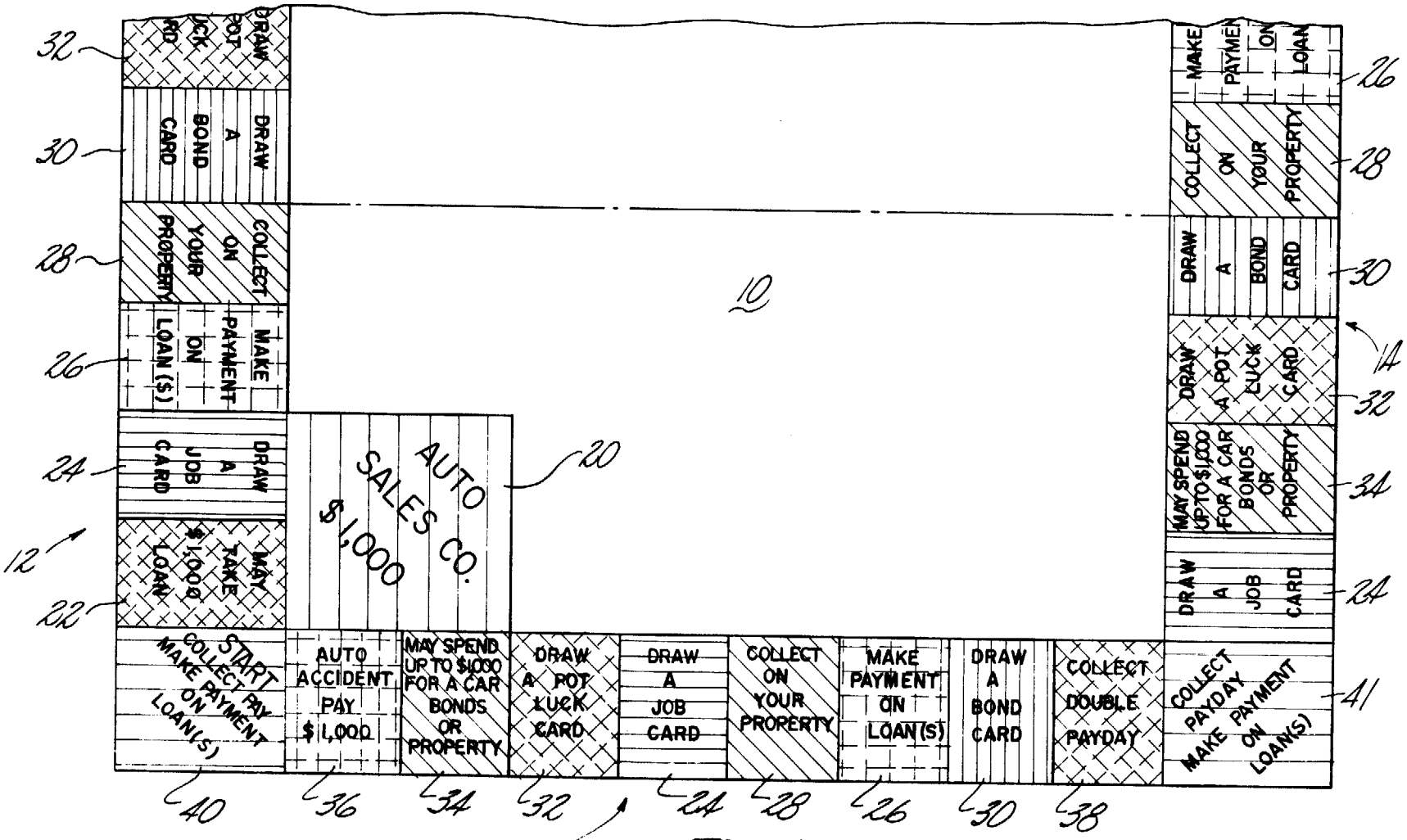

With reference to FIGS. 1 and 1A, there is illustrated a game board, generally denoted as 10, according to the present invention.

Figure 13:
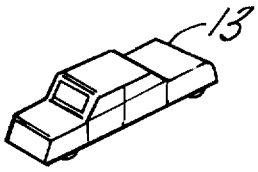
FIG. 13 illustrates one game piece.
Figure 14:
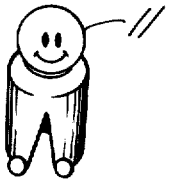
FIG. 14 illustrates another game piece.

The game apparatus of the present invention also contains a first game piece 11 (see FIG. 14) which generally resembles and represents a human being, and a second game piece 13 (see FIG. 13) which generally resembles and represents an automobile. Each of the first game pieces are of a different color, and each second game piece 13 is of the same color as a different one of the first game pieces 11, i.e., first game piece 11 has a corresponding second game piece 13.

According to the preferred embodiment, the game board 10 includes a first side 12, a third side 14, a second side 15 generally perpendicular to and interconnecting the first side 12 and third side 14, and a fourth side 16 generally parallel to the second side 15.

A plurality of game board squares are located along each of the first side 12, second side 15, third side 14 and fourth side 16. Each side of the game board has the same number of game board squares. Each of the game board squares has directional information printed therein.

A first block 20 is located at the intersection of the first side 12 and the fourth side 16. This first block carries printed information pertaining to the sales of motor vehicles, particularly automobiles. This first block 20 could easily carry, for example, an advertisement for an automobile company or automobile dealership.

The plurality of game board squares along the first side 12 consist of a first game board square 22 having, generally, the direction "may take $1000 loan"; a second game board square 24 having, generally, the direction "draw a job card"; a third game board square 26 having, generally, the direction "make payment on loan(s)"; a fourth game board square 28 having, generally, the direction "collect on your property"; a fifth game board square 30 having, generally, the direction "draw a bond card"; a sixth game board square 32 having, generally, the direction "draw a pot luck card"; a seventh game board square 34 having, generally, the direction "may spend up to $1000 for a car, bonds or property"; and another of the second game board squares 24, in that sequence progressing from right to left along the first side 12.

The plurality of game board squares along the second side 15 consist of one of the first game board squares 22; one of the fifth game board squares 30; one of the third game board squares 26; one of the fourth game board squares 28; one of the second game board squares 24; one of the sixth game board squares 32; one of the seventh game board squares 34; and an eighth game board square 36 having, generally, the direction "auto accident, pay $1000", in that sequence progressing right to left along the second side.

The plurality of game board squares along the third side 14 consist of one of the first game board squares 22; one of the second game board squares 24; one of the third game board squares 26; one of the fourth game board squares 28; one of the fifth game board squares 30; one of the sixth game board squares 32; one of the seventh game board squares 34; and another one of the second game board squares 24, in that sequence progressing right to left along the third side 14.

The plurality of game board squares along the fourth side 16 consist of a ninth game board square 38 having, generally, the direction "collect double payday"; one of the fifth game board squares 30; one of the third game board squares 26; one of the fourth game board squares 28; one of the second game board squares 24; one of the sixth game board squares 32; one of the seventh game board squares 34; and one of the eighth game board squares 36 in that sequence progressing right to left along the fourth side 16.

A first corner square 40 having, generally, the direction "Start, collect pay, make payment on loan(s)" is located at the intersection of the first side 12 and the fourth side 16. A second corner square 41 having, generally, the direction "collect payday, make payment on loan(s)" is located at the intersection of the third side 14 and fourth side 16. A third corner square 43 similar to the first and second corner squares 40, 41, but having, generally, the direction "tax refund - collect $1000" is located at the intersection of the third side 14 and second side 15. Further, fourth corner square 47, like the second corner square 41, is located at the intersection of the first side 12 and second side 15.

The game apparatus includes a plurality of information members which bear information and directions relating to the various game board squares.

Figure 12:
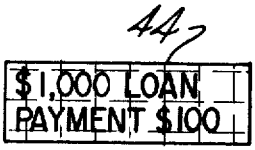
FIG. 12 illustrates a play information member.
Figure 6:
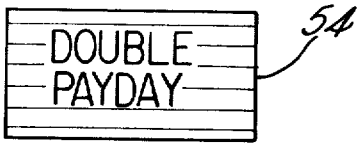
FIG. 6 illustrates the front surface of another embodiment of the play directing card of FIG. 4.
Figure 9:
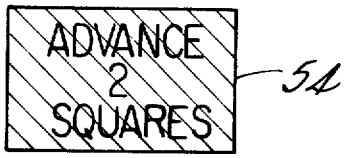
FIG. 9 illustrates the front surface of yet a further embodiment of the play directing card of FIG. 4.

The preferred embodiment of the present invention includes a plurality of first information members 44 (see FIG. 12) each of which contain installment loan information setting forth the dollar amount of a loan and the amount of money to be repaid on each installment when directed to do so by the rules of the game. The dollar amounts can be varied. Therefore, loan installment members are supplied in various face value amounts and indicate a corresponding installment payment. Preferably a player taking a loan of money from a central bank receives twelve installment members 44, and turns in one installment member 44 each time the player makes an installment payment to the central bank so that when the player has paid off the loan he no longer has any installment members 44 in his possession. Loan members 44 are included in the game in values of $1000, $2000, $3000, and $4000 loans. Each of the twelve repayment installments on a $1000 loan are $100; each of the 12 repayment installments on a $2000 loan are $200; each of the 12 repayment installments on a $3000 loan are $300; and each of the 12 repayment installments on a $4000 loan are $400.

Figure 11:
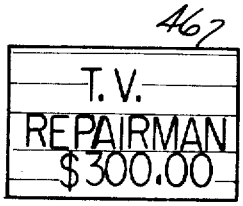
FIG. 11 illustrates a play information member.
Figure 5:
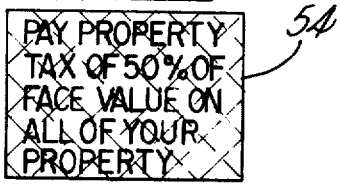
FIG. 5 illustrates the front surface of one embodiment of the play directing card of FIG. 4.
Figure 8:
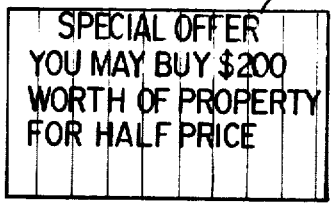
FIG. 8 illustrates the front surface of yet a further embodiment of the play directing card of FIG. 4.

A plurality of second information members or job members 46 (see FIG. 11) contain information relating to various jobs including the name of the job and an amount of money to be paid to a player in possession thereof when so directed by the rules by a central bank. In the preferred embodiment, the job members consist of the following jobs and salaries: Doctor —$500; TV repairman — $300; plumber — $200; lawyer — $500; politician — $500; clerk — $100; policeman — $400; postman — $200; janitor — $100; Engineer — $500; accountant — $300; painter — $200; electrician — $200; jeweler — $300; fireman — $500; mechanic — $100; teacher — $300; and cook — $100. Further, the game apparatus should contain two of each of the above described job members 46, wherein one of the two members relating to the same job has the nunber 1 (not shown) designated thereon and the other of the two members has the number 2 (not shown) designated thereon.

Figure 2:
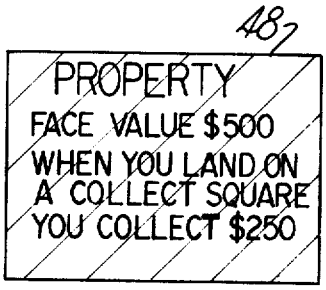
FIG. 2 illustrates a play information member.
Figure 7:
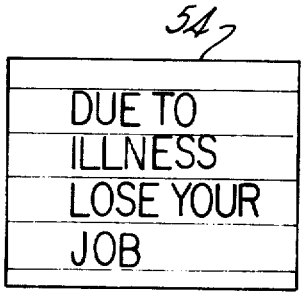
FIG. 7 illustrates the front surface of a further embodiment of the play directing card of FIG. 4.

A plurality of third information members 48 (see FIG. 2) each contain information relating to property which includes the face value of a property and the amount of money to be paid to a player in possession thereof when so directed by the rules by a central bank. In the preferred embodiment, the property members 48 consist of the following: property having a face value of $500 and stated collection value of $250; property having a face value of $1000 and stated collection value of $500; property having a face value of $1500 and stated collection value of $750; property having a face value of $2000 and stated collection value of $1000; property having a face value of $3000 and stated collection value of $1500 and property having a face value of $2500 and stated collection value of $1250.

Figure 3:
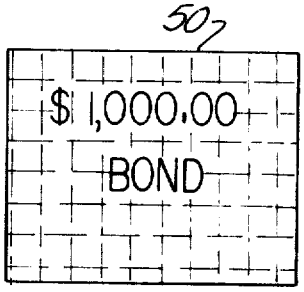
FIG. 3 illustrates a play information member.
Figure 4:
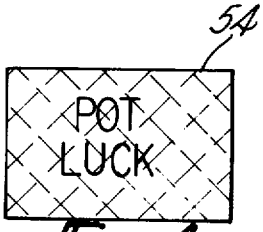
FIG. 4 illustrates the back surface of a play directing card.

A plurality of fourth information members 50 (see FIG. 3) each contain information relating to bonds and includes the face value of a bond. In the preferred embodiment, the bonds 50 consist of the following: bonds having a face value of $1000; bonds having a face value of $2000; and bonds having a face value of $3000.

Figure 10:
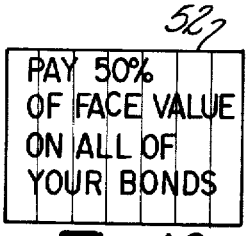
FIG. 10 illustrates the front surface of yet a further embodiment of the play directing card of FIG. 4.

A plurality of play directing fifth information members or cards 52, or bond cards, (see FIG. 10) each contain information pertaining to the fourth information members or bonds 50, and includes directions to either collect a percentage of the face value of the bonds from a central bank, or pay a percentage of the face value of the bonds in the possession of a player drawing one of these fifth cards 52 to a central bank when directed to do so by the rules. In the preferred embodiment, the bond cards 52 consist of the following: 36 cards directing a player to pay, to a central bank, 50 percent of the value of all bonds 50 in his possession; six cards directing a player to collect, from a central bank, 10 percent of the value of all bonds 50 in his possession; three cards directing a player to collect, from a central bank, 20 percent of the value of all bonds 50 in his possession; three cards directing a player to collect, from a central bank, 30 percent of the value of all bonds 50 in his possession; three cards directing a player to collect, from a central bank, 40 percent of the value of all bonds 50 in his possession; three cards directing a player to collect, from a central bank, 50 percent of the value of all bonds 50 in his possession; three cards directing a player to collect, from a central bank, 60 percent of the value of all bonds 50 in his possession; three cards directing a player to collect, from a central bank, 70 percent of the value of all bonds 50 in his possession; three cards directing a player to collect, from a central bank, 80 percent of the value of all bonds 50 in his possession; three cards directing a player to collect, from a central bank, 90 percent of the value of all bonds 50 in his possession and six cards directing a player to pay to a central bank 50 percent of the value of all bonds 50 in his possession.

A plurality of play directing sixth information members or cards 54, or pot luck cards (see FIGS. 4–9), each contain directions relating to the information contained on the second information members 46, or third information members 48, or fourth information members 50, or additional information directing the player drawing one of these pot luck cards 54 to advance his game piece two squares, pay money due to an auto accident, pay income taxes of a predetermined amount, or collect a tax refund of a predetermined amount. Preferably, the pot luck cards 54 relating to information contained on the second members 46 direct a player to collect a double payday, or to lose his jobs due to illness; while the pot luck cards 54 relating to information contained on the third members 48 direct the player to pay property tax of a percentage of the face value of property as indicated on the third members 48 in his possession, or to collect the face value of property as indicated on the third members 48 in his possession, or to sell all the property represented by the third members 48 in his possession for half of the face value indicated on the third members 48; or to purchase up to $2000 worth of property represented by the third members 48 for half of the face value amount indicated thereon; and the pot luck cards 54 relating to information contained on the fourth members 50 direct a player to sell all of the bonds represented by the fourth members 50 in his possession for half of the face value indicated on the fourth members 50, or to purchase up to $2000 of bonds represented by the fourth members 50 for half of the face value indicated thereon.

It should be obvious at this point that: the first game board square 22 relates to the first information members 44; the second game board square 24 relates to the second information members 46; the third game board square 26 relates to the first information members 44; the fourth game board square 28 relates to the third information members 48; the fifth game board square 30 relates to the play directing fifth card 52 and the fourth information member 50; the sixth game board square 32 relates to the play directing sixth cards 54; the seventh game board square 34 relates to acquiring the third information members 48, to acquiring fourth information members 50, and to acquiring a second game piece 13; the eighth game board square relates to a player in possession of a second game piece 13; and the ninth game board square relates to the second information or job members 46.

Figure 15:
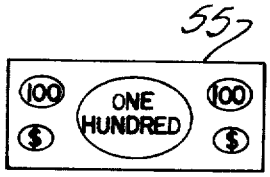
FIG. 15 illustrates one denomination of artificial money used in the game.

Included as components of the game apparatus of the present invention are representations of random monetary units 55 (see FIG. 15) such as imitation money preferably in amounts of $50; $100; $500; $1000; $5000; and $10,000.

Figure 16:
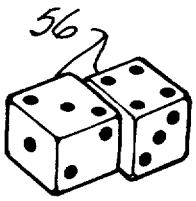
FIG. 16 illustrates a pair of dice used in the game.

A pair of dice 56 (see FIG. 16) is also included.

The rules and method of playing the game of the present invention using the above described game apparatus is as follows:

Each player chooses a first game piece 11 and places it in the first corner square 40, and places a second game piece 13, corresponding in color to his chosen first game piece 11, in the first block 20 which represents an automobile sales facility.

Next, each player throws or rolls the pair of dice 56 to determine the sequence of play. The player throwing the highest value will begin the game and the play will continue to the other players in clockwise sequence around the game board.

For the sake of clarity, the following description will refer only to one player, it being understood, however, that the play is to continue to the next player after each throw or roll of the dice and appropriate moves of a game piece 11 or 13 by the prior players of the game. The players of the game begin the game with no assets, i.e., no money, property or bonds; and with no liabilities, i.e., no loans or other debts.

A player begins play by throwing one die of the pair of dice 56 and moving his first game piece 11 a number of squares corresponding to the value indicated on the die. The player then follows the instructions on the game board square upon which his first game piece 11 has come to rest. The play then advances to the next player, and so forth around the game board.

When the player purchases a second game piece 13, he may throw the pair of dice 56 and move his second game piece 13 in a two step sequence, first: a number of game board squares corresponding to the value indicated on either one of the pair of dice 56, and after following the instructions on the game board square upon which his second game piece 13 has come to rest, second: moving his second game piece a number of game board squares corresponding to the value indicated on the other die of the thrown pair of dice 56, and following the instructions on the game board square upon which this second game piece has come to rest. The play then advances to the next player, and so forth around the game board.

To further explain the method of play, the following explanation will detail what occurs as a game piece lands on each of the different game board squares.

When the player's game piece lands or comes to rest upon the first game board square 22, the player may take out a loan of $1000. Upon making the loan, the player receives $1000 from a central bank and a set of 12 payment cards, a first information member 44, or loan installment members, indicating thereon that the player is to make installment payments of $100 when directed to make a payment on the loan. It is desirable for a player to initially take a loan for the reason that, as indicated above, each player starts the game without any money.

When the player's game piece comes to rest upon the second game board square 24, the player must draw a second information member 46, or a job member, from a stack of job members. The player drawing a particular job member 46 can retain it in his possession only if it has the number 1 designated thereon; or if the particular job member has a number 2 designation and he already possesses the same particular job member 46 with the second game board square 24 and having drawn it at that time or if he is already in possession of a job member having the number 1 designated thereon, but at a previous time in the game having landed on the second game square 24 and having drawn it at that time. A player may possess up to two job members 46 at a time. These job members may be for two different jobs or they may both be for the same job, in which case one job member would carry the number 1 designation and the other would carry the number 2 designation. Further, even though a player is already in possession of the maximum number of job members 46, he may continue to draw additional job members 46 when his game piece comes to rest upon a second game board square 24, and if he draws a job member 46 carrying the number 1 which is of a higher value than the job member 46 carrying the number 1 already in his possession, he may trade the member 46 in his possession for the member 46 of a higher value by returning the member 46 in his possession and of lower value to the bottom of the stack. If a player draws a job member 46 carrying the number 2, he may trade it for the job member 46 carrying the number 2 already in his possession of a lower value by returning the job member 46 in his possession to the bottom of the stack. A player may follow this process until he has two job members 46, one numbered 1 and one numbered 2, and both having the amount of $500 indicated on them which is the highest amount indicated on the job members 46. At this time he will not draw job members 46. However, if a player should lose his jobs, he will simply start this process over again.

When the player's game piece comes to rest upon the third game board square 26 he must make one installment payment to a central bank on all loans which he has received. Note, the value of each installment is printed on the first information members 44, and the player is to turn in one of these members with his payment to the central bank. If the player has no outstanding loans, he is to disregard the instruction contained in the third square 26.

When the player's game piece comes to rest upon the fourth game board square 28, he is to collect from the central bank the face value indicated on any of the third information members 48, or property members, in his possession, having obtained the property member 48 at a previous time in the game in a manner to be hereinbelow described. Of course, if the player has no property members 48 in his possession, he receives no money and merely ignores the information in this fourth game board square 28.

When the player's game piece comes to rest upon the fifth game board square 30, he may draw a play directing fifth card 52, or bond card, from a stack of play directing fifth cards 52 and either receive from, or pay to, a central bank a percentage indicated thereon of the face value of all fourth information members 50, or bonds, in his possession, having obtained the bond 50 at a previous time in the game in a manner to be hereinbelow described. Of course, if the player has no bond members 50 in his possession, he does not draw a bond member and merely ignores the fifth play directing card 52.

When the player's game piece comes to rest upon the sixth game board square 32, he must draw a play directing sixth card 54, or pot luck card, from a stack of pot luck cards 54, and follow the directions printed thereon. However, not all of the pot luck cards 54 are applicable to every situation. Therefore, each of the preferred pot luck cards 54 will be explained. If the pot luck card 54 instructs the player to collect a double payday, he may do so only if he has a second information member 46 already in his possession. If he is not in possession of a second information member 46, he merely ignores the collect double payday pot luck card 54. If the pot luck card 54 instructs the player to lose his job members 46 due to illness, he must return any job members 46 in his possession to the stack of job members 46. If he is not in possession of any job members 46, he merely ignores the lose job pot luck card 54. If the pot luck card 54 instructs the player that he may buy up to $2000 worth of fourth information members, or bonds 50, the player may so purchase only if he has money. A player may not take a loan to make a purchase. If the pot luck card 54 instructs the player to sell all of the third information members 48, or property members 48, in his possession at half price, he must do so, and will receive half of the face value indicated on the face of the property members 48 in his possession from the central bank and must return the property members 48 to the central bank. If the pot luck card 54 instructs the player to sell all of the fourth information members, or bond members 50, in his possession at half price, he must do so, and will receive half of the face value indicated on the face of the bond members 50 in his possession from the central bank and must return the bond members 50 to the central bank. If the pot luck card 54 instructs the player to collect on property members 48, or third information members, in his possession, he will receive from the central bank the value indicated on the face of all the property members 48 in his possession. If the player does not possess any property members 48, or third information members, he merely ignores the collect on property pot luck card 54 and returns it to the bottom of the stack of pot luck cards 54. If the pot luck card 54 instructs the player to pay property tax of 50 percent of face value on all property, the player must pay the amount due the central bank, the dollar amount determined by referring to the value indicated on the third information members, or property members 48. If the player does not have enough money to pay this tax, he must take a loan and will receive from the central bank a set of installment loan repayment members 44. If the pot luck card 54 instructs the player to pay income tax of $500, he must make the payment to the central bank. If the player does not have the money to make the payment, he must take a loan from the central bank and will receive from the central bank a set of installment loan repayment members 44. If the pot luck card 54 instructs the player to pay $1000 due to an auto accident, he must do so only if he is moving his second game piece 13 resembling an automobile. If he is moving a second game piece 13, he must pay the $1000 to the central bank, and if he does not have the money, he must take a loan from the central bank and will receive from the central bank a set of installment repayment members 44. If the player is moving a first game piece 11, he may ignore the auto accident pot luck card 54. If the pot luck card 54 instructs the player to advance two squares, the player must move or advance his game piece two game board squares, and follow the instructions in the game board square upon which his game piece comes to rest. If the pot luck card 54 instructs the player that he is to receive a tax refund of $500, he collects $500 from the central bank, and returns the tax refund pot luck card 54 to the stack of pot luck cards 54.

When the players first game piece 11 comes to rest upon the seventh game board square 34, the player has the option to spend up to $1000 either for a second game piece 13 representing an automobile, or for the purchase of bonds represented by the fourth information members 50, or for the purchase of property represented by the third information members 48. If, however, the player is moving a second game piece 13 when he lands on the seventh game board square 34, the player has only the option of purchasing bonds, or property. One player cannot possess more than one second game piece 13. Further, the player must already have the money. The player may not otherwise make a loan, nor borrow from other players. If the player does not have enough money to make a purchase he merely ignores the instruction in the seventh game board square.

When a player's game piece comes to rest upon the eighth game board square 36, the player must pay $1000 due to an auto accident. This game board square is only applicable if the player is moving the second game piece 13 resembling an automobile. The money is paid to the central bank. If the player does not have enough money to pay for the accident, he must take out a loan and will receive a set of twelve loan repayment members 44. If the player is moving his first game piece 11, he may ignore the instruction to pay $1000 due to an auto accident because it is not applicable.

When a player's game piece comes to rest upon the ninth game board square 38, the player will collect a double payday from the central bank, the dollar amount being determined by referring to the second information members or job members 46 in his possession. Of course, if the player does not possess any job members 46, he will not collect any money, and merely ignores the instruction.

After play has begun, when a player's game piece comes to rest upon the first corner square 40, or the second corner square 41 the player will collect a payday, if he is in possession of a second information member, or job member 46, the dollar amount being determined by referring to the job members 46 in his possession, and he must also make an installment payment on all outstanding loans previously made, the amount of the installment payment being determined by referring to the fourth information members, or loan installment members 44 in his possession. If the player does not have enough money to make his installment payment, he must take another loan from the central bank and will receive more loan installment members 44. If this occurs, he shall, at this point, only make an installment payment on the loans he had outstanding when his game piece landed on the first or second corner square 40 or 41.

When a player's game piece comes to rest upon the third corner square, he will receive from the central bank a tax refund of $1000.

The winner of the game is the first player to accumulate assets of at least $25,000 and have paid off all of his loans. The assets include money, property as represented by the third information members 48, and bonds as represented by the fourth information members 50. An automobile, as represented by the second game piece 13, and a job, as represented by the second information members 46, are not assets and are not included in determining the assets. A player must declare himself the winner to win the game.

The foregoing detailed description is given primarily for clarity of understanding and no unnecessary limitations should be understood therefrom, for modifications will be obvious to those skilled in the art and may be made without departing from the spirit of the invention or the scope of the appended claims:

I claim:

1. A game apparatus, which comprises in combination:

a plurality of first movable game pieces, each of said first movable game pieces being of a different color;

a plurality of second movable game pieces, equal in number to said first movable game pieces, and each being of the same color as a different one of said first movable game pieces;

a substantially square game board having a first side, second side, third side and fourth side;

a plurality of squares located along said first side, said second side, said third side and said fourth side of said game board for accommodating said first and second movable game pieces;

directional information printed in each of said squares;

a first corner square located at the intersection of said squares along said first side and said squares along said fourth side of said game board;

directional information printed in said first corner square;

a second corner square located at the intersection of said squares along said first side and said squares along said second side of said game board;

directional information printed in said second corner square;

a third corner square located at the intersection of said squares along said second side and said squares along said third side of said game board;

directional information printed in said third corner square;

a fourth corner square located at the intersection of said squares along said third side and said squares along said fourth side of said game board;

directional information printed in said fourth corner square;

a first block disposed generally at one corner of said game board adjacent the intersection of said squares located along two of said sides of said game board;

information printed in said first block;

a plurality of first information members containing printed information pertaining to directional information printed in a predetermined number of said squares and relating to the loan of money;

a plurality of second information members containing printed information pertaining to directional information printed in a predetermined number of said squares and relating to various jobs;

a plurality of third information members containing printed information pertaining to directional information printed in a predetermined number of said squares and relating to property;

a plurality of fourth information members containing printed information pertaining to directional information printed in a predetermined number of said squares and relating to bonds;

a plurality of play directing fifth information members containing directional information pertaining to directional information printed in a predetermined number of said squares and further pertaining to information contained on said fourth information members, which directional information relates to the payment and receipt of money related to the value of bonds;

a plurality of play directing sixth information members containing directional information printed in a predetermined number of said squares and further pertaining to information contained on said second information members, said third information members and said fourth information members, which directional information relates to the payment and collection of money and the advancement of the game pieces;

a predetermined amount of artificial money of various face value amounts to be distributed to the players of the game apparatus as a loan to be repaid; and a pair of dice to be thrown one die at a time or together by the players of the game to determine the movement of said first game piece and said second game piece, respectively.

2. A game apparatus as defined in claim 1, wherein said plurality of squares consists of:

at least one first square having, generally, the instruction, "may take $1000 loan", thereon;

at least one second square having, generally, the instruction, "draw a job card", thereon;

at least one third square having, generally, the instruction, "make payment on loan (s)", thereon;

at least one fourth square having, generally, the instruction, "collect on property", thereon;

at least one fifth square having, generally, the instruction, "draw a bond card", thereon;

at least one sixth square having, generally, the instruction, "draw a pot luck card", thereon;

at least one seventh square having, generally, the instruction "may spend up to $1000 for a car, bonds, or property", thereon;

at least one eighth square having, generally, the instruction, "auto accident, pay $500", thereon;

at least one ninth square having, generally, the instruction, "collect double payday", thereon;

said first corner square having, generally, the instruction, "start, collect pay, make payment on loan (s)", thereon;

said second corner square having, generally, the instruction, "collect payday, make payment on loan (s)", thereon; and said third corner square having, generally, the instruction, "tax refund, collect $1000", thereon.

3. A game apparatus as defined in claim 1, wherein:

a. said plurality of squares located along said first side of said game board consists of:
one of said first squares;
two of said second squares;
one of said third squares;
one of said fourth squares;
one of said fifth squares;
one of said sixth squares; and
one of said seventh squares b. said plurality of squares located along said second side of said game board consists of:
one of said first squares;
one of said second squares;
one of said third squares;
one of said fourth squares;
one of said fifth squares;
one of said sixth squares;
one of said seventh squares; and
one of said eighth squares;

c. said plurality of squares located along said third side of said game board consists of:
one of said first squares;
two of said second squares;
one of said third squares;
one of said fourth squares;
one of said fifth squares;
one of said sixth squares; and
one of said seventh squares; and d. said plurality of squares located along said fourth side of said game board consists of:
one of said second squares;
one of said third squares;
one of said fourth squares;
one of said fifth squares;
one of said sixth squares;
one of said seventh squares;
one of said ninth squares; and
one of said eighth squares.

4. A game apparatus as defined in claim 3, wherein:

the sequence of said plurality of squares located along said first side of said game board being, one of said first squares, one of said second squares, one of said third squares, one of said fourth squares; one of said fifth squares, one of said sixth squares, one of said seventh squares, and another one of said second squares progressing from right to left along said first side;

the sequence of said plurality of squares located along said second side of said game board being one of said first squares, one of said fifth squares, one of said third squares, one of said fourth squares, one of said second squares, one of said sixth squares, one of said seventh squares, and one of said eighth squares, progressing from right to left along said second side;

the sequence of said plurality of squares located along said third side of said game board being one of said first squares, one of said second squares; one of said third squares, one of said fourth squares, one of said fifth squares, one of said sixth squares, one of said seventh squares, and another one of said second squares progressing from right to left along said third side; and the sequence of said plurality of squares located along said fourth side of said game board being one of said ninth squares, one of said fifth squares, one of said third squares, one of said fourth squares, one of said second squares, one of said sixth squares, one of said seventh squares, and one of said eighth squares progressing from right to left along said fourth side.

5. A game apparatus as defined in claim 1, wherein:

each of said first movable game pieces generally resembles a human being; and each of said second movable game pieces generally resembles a motor vehicle.

6. A game apparatus as defined in claim 1, wherein:

a. said plurality of first information members consists of information pertaining to directional information printed on said first squares, said third square, said first corner square, and said second corner square;

b. said plurality of second information members consists of information pertaining to directional information printed on said second square, said first corner square, and said second corner square;

c. said plurality of third information members consists of information pertaining to directional information printed on said fourth square and said seventh square;

d. said plurality of fourth information members consists of information pertaining to directional information printed on said fifth square and said seventh square;

e. said plurality of play directing fifth information members consists of information pertaining to directional information printed on said fifth square and which also relates to information printed on said fourth information members; and f. said plurality of play directing sixth information members consists of information pertaining to directional information printed on said sixth square and which also relates to information printed on said second, third, and said fourth information members.

7. A game apparatus as defined in claim 6, wherein:

each of said first information members bears information setting forth the face value of a loan of money and the amount of money corresponding to one repayment installment to be paid by the holder of said first information member when so directed by the rules of the game;

each of said second information members bears the name of a job and the amount of money to be paid to the player holding said second information member when so directed by the rules of the game;

each of said third information members bears information setting forth the monetary face value of property and the amount of money to be collected by the player holding said third information member when so directed by the rules of the game;

each of said fourth information members bears a monetary value of a bond, to be paid to or paid by the player holding said fourth information member when so directed by the rules of the game;

each of said play directing fifth information members bears directional information directing the player holding said play directing fifth information members to pay or collect a percentage of the monetary value of a bond as indicated on any of said fourth information members also held by the player;

said plurality of play directing sixth information members consists of:

a. a plurality of cards bearing the direction to advance one of said game pieces a predetermined number of squares;

b. a plurality of cards bearing the information to sell all of the bonds as represented by said fourth information members held by the player drawing one of these cards for half price, c. a plurality of cards bearing the direction to collect a double payday, the amount of money to be collected being determined by reference to said second information members held by the player drawing one of these double payday cards;

d. a plurality of cards bearing the direction to pay a predetermined amount of money because of an auto accident, which auto accident card is only applicable if the player drawing it is in possession of one of said second movable game pieces;

e. a plurality of cards bearing the direction to purchase a predetermined monetary amount of bonds as represented by said fourth information members for a fraction of their value as indicated on said fourth information members;

f. a plurality of cards bearing the instruction to pay property tax of a predetermined percentage of all property held by the player drawing this property tax card, the monetary amount of tax to be paid being determined by reference to said third information members held by said player;

g. a plurality of cards bearing the instruction to pay a predetermined monetary amount of income taxes;

h. a plurality of cards bearing the instruction that the player drawing this card loses his jobs as represented by said second information members held by said player;

i. a plurality of cards bearing the instruction to collect a tax refund of a predetermined amount of money;

j. a plurality of cards bearing the instruction that a player drawing this card is to collect an amount of money stated on said third information members held by said player;

k. a plurality of cards bearing the instruction that a player drawing this card sell all his property as represented by said third information members held by said player at a fraction of the monetary value indicated on said third information members; and l. a plurality of cards bearing the instruction that a player drawing it may purchase a predetermined monetary amount of property as represented by said third information members for a fraction of their value as indicated on said third information member.

8. A game apparatus as defined in claim 7, wherein the number of said first information members corresponding to a loan of money to a player equals the number of installment payments to be made by said player when directed to do so by the rules.

* * * * *